United States Patent [19]

Holl

[11] Patent Number: 4,546,400

[45] Date of Patent: Oct. 8, 1985

[54] METHOD AND APPARATUS OF PROTECTING A COATING PLANT AGAINST EXPLOSION

[75] Inventor: Walter Holl, Stuttgart, Fed. Rep. of Germany

[73] Assignee: Robert Bosch GmbH, Stuttgart, Fed. Rep. of Germany

[21] Appl. No.: 500,762

[22] Filed: Jun. 3, 1983

[51] Int. Cl.[4] ..... B05B 5/02

[52] U.S. Cl. ..... 361/1; 361/227

[58] Field of Search ..... 361/227, 1, 226, 225, 361/93, 87, 86, 235; 324/62, 307, 127, 131

[56] References Cited

U.S. PATENT DOCUMENTS

Re. 28,394 4/1975 Point ..... 361/227

3,970,920 7/1976 Braun ..... 361/227

FOREIGN PATENT DOCUMENTS 1383104 2/1975 United Kingdom .

*Primary Examiner*—A. D. Pellinen

*Assistant Examiner*—Hong K. Choe

*Attorney, Agent, or Firm*—Michael J. Striker

[57] ABSTRACT

A method of protecting a plant for coating objects with charged particles as well as a method and apparatus for coating objects is proposed. The generation of an electric arc having a too high energy which can cause an ignition of the particles to be applied onto the object is prevented by applying a test high voltage between the object to be coated and the respective earth connection. An insulation occurring between the object to be coated and the respective earth connection and having a contact resistance smaller than a permitted maximum value is overcome by an arcthrough of lower energy. The current flowing in the closed circuit is measured for determining the contact resistance of the insulation so that the operation of the plant can be stopped when the actual value of the current is below a minimum value as in this case the insulation cannot be overcome by the arcthrough as its contact resistance is higher than the permitted maximum value.

16 Claims, 1 Drawing Figure

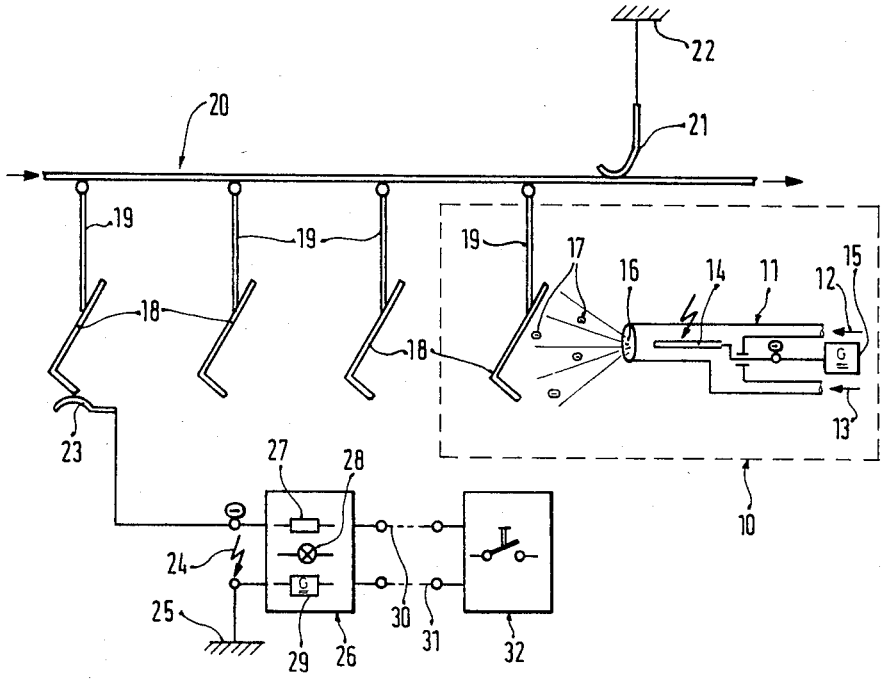
22
21
20
19
19
19
17
16
14
11
12
15
18
18
13
23
27
28
10
24
25
29
26
30
31
32

METHOD AND APPARATUS OF PROTECTING A COATING PLANT AGAINST EXPLOSION

BACKGROUND OF THE INVENTION

The present invention relates to a method and apparatus for coating objects. In particular, the invention is concerned with a method of protecting a coating plant for coating objects with particles against danger of explosion by sparkovers obtained through electric charge of the objects to be coated.

The coating of powder or particles can provide an insulation between the object to be coated and the holding means on which the objects are connected. Consequently, the contact of the object to the respective earth potential is not guaranteed any more. Due to the present capacitance, a sparkover in form of an arc can be caused between the object and the holding means when applying high direct voltage for the coating, which sparkover has sufficient energy for igniting the particles to be coated on the object.

Methods for surveying a coating plant are already disclosed which are known under the catchword "earthing control". In these known methods, the electrical resistance between the object to be coated and the holding means is measured with low direct voltage wherein the contact resistance must not exceed a value of 1 Mohm. In case of a higher contact resistance, there is the danger that the capacity obtained by the insulated object to be coated is storing sufficient energy in connection with the high voltage applied during the coating with particles in order to ignite the powder-air mixture to be sprayed on the object when a sparkover is obtained. Especially when using small objects it proves to be rather impossible to meet the requirement with respect to the desired magnitude of the resistance. In view of the relatively small weight of the objects and the unavoidably thin insulating films which are obtained on the holding means upon the powder coating, it is not guaranteed to maintain the contact resistance below 1 Mohm so that the plant is frequently brought to a standstill.

It is further known that arc discharge having an arc energy below 5 mWs is not dangerous with regard to explosions in such powder coating plants. These arcs cannot ignite the powder of particles to be sprayed on the object, and consequently are not dangerous, so that even upon a contact resistance above 1 Mohm, which is measured with low voltage, the plant must not necessarily be stopped.

SUMMARY OF THE INVENTION

It is a general object of the invention to overcome the difficulties of the prior art which resides in a frequent standstill of coating plants.

More particularly, it is an object of the present invention to provide a method of protecting a coating plant against explosions by sparkovers obtained through electric charge of the objects to be coated.

Yet another object of the invention is to provide a method of protecting a coating plant which reduces the requirement to stop the coating plant considerably by allowing an operation of the plant even at contact resistance above 1 Mohm.

In keeping with these objects, and with others which will become apparent hereafter, one feature of the invention resides, briefly stated, in a method in which a high voltage is successively applied to one of the objects to be coated when the object closes the circuit for preventing between the object and/or the holding means and the first earth connection the generation of an electric arc of an energy higher than a permitted maximum energy wherein an insulation having a contact resistance smaller than a permitted maximum contact resistance and occuring between the object and/or the holding means and the respective earth connection is overcome by an arc through having an energy smaller than the permitted maximum energy and in which the current flowing in the closed circuit is measured for determining when the insulation has a contact resistance higher than the permitted maximum contact resistance thereby stopping the plant as the actual current is below a minimum value.

Through the provision of such a method, a distinction between dangerous and non-dangerous insulations occurring between the object and the holding means can be determined, i.e. that even in case the insulation has a contact resistance above 1 Mohm the coating plant must not necessarily be stopped as in prior art methods which depend on the measurement of the contact resistance. This resides primarily therein that the current flowing in the closed circuit is measured and only when the current is below a minimum value the plant is stopped.

A further advantage of the present invention is the fact that in a very simple and economical manner insulations between the object to be coated and the holding means are broken through or overcome by an electric arc of limited energy in case the insulation has a contact resistance smaller than a maximum value. The object to be coated is then subjected to a high voltage applied upon the coating process with particles, and no electric arc having a higher energy content can occur, so that the danger of explosion is prevented and a continuous operation is guaranteed, although a high contact resistance could be determined. As already mentioned, the plant is only stopped when the current is below a minimum value because under these circumstances, the insulation is too thick and has a too high contact resistance to be overcome.

According to another feature of the invention, the use of direct voltage is advantageous which has the same polarity as the high voltage applied in the coating means. The use of direct voltages as applied to the object to be coated and the coating means and especially by using corresponding polarity it is guaranteed that any occurring electric arcs do not have a higher energy than the electric arcs occurring when overcoming the insulation during a test phase.

It is especially advantageous to use for the coating as well as for charging the objects to use a negative direct voltage because with respect to occurring insulations, a negative direct voltage can be easier controlled as a positive direct voltage upon which a higher insulation distance must be maintained.

Upon the capacitances usually occurring between the objects to be coated which are suspended in an insulating manner, and the holding means, test direct voltages between 1 and 5 kV have been proven advantageous although even higher test voltages are admissible without reaching the critical igniting energy for the particle-air mixture.

According to another feature of the invention, an apparatus for coating objects in a coating plant comprises a coating chamber provided with means for spraying charged particles onto the objects, means for holding and continuously feeding the objects to the coating chamber, wherein the holding means are connected to a first earth connection, means for applying successively a high voltage between one of the objects and a second earth connection, when the object closes the circuit, for preventing between the object and/or the holding means and the first earth connection a generation of an electric arc of an energy higher than a permitted maximum energy wherein an insulation having a contact resistance smaller than a permitted maximum contact resistance between the object and/or the holding means and the first connection is overcome by an arc through having an energy smaller than the permitted maximum energy and means for measuring the current flowing in the closed circuit for determining when the insulation has a contact resistance higher than the permitted maximum contact resistance thereby stopping the plant at the actual current is below a minimum value.

Still another feature of the present invention is a method for coating objects in a coating plant which, briefly stated, comprises the steps of connecting the object to a first earth connection via holding means, guiding the object along a predetermined path, applying successively a test high voltage between one of the objects and a second earth connection when the object closes the circuit, measuring the current flowing in the closed circuit for determining when the insulation has a contact resistance higher than the permitted maximum contact resistance, spraying charged particles onto the object, and melting and curing the particles adhered to the object for providing a coating thereon.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE shows schematically a coating plant wherein a test high voltage is applied to objects to be coated.

DESCRIPTION OF THE PREFERRED EMBODIMENTS

Referring to the FIGURE, there is shown a coating chamber 10 in which a spraying pistol 11 is arranged. The spraying pistol 11 is provided for spraying particles or powders onto objects 18 and is provided with a particle inlet 12 and an air inlet 13. Provided within the spraying pistol 11 is a high voltage electrode 14 to which a negative direct voltage of approximately 80–100 kV is applied by a DC supply source 15. The spraying pistol 11 is further provided with a particle outlet 16 from which a cloud of coating particles and air is discharged wherein the powder particles 17 are negatively charged because of the applied negative high direct current.

The objects 18 which are to be coated within the chamber 10 are only schematically illustrated and can be smaller objects like reflectors or bigger objects like for example the housings of refrigerators or like household devices. The objects 18 are connected to holding means 19 and depend therefrom and the holding means 19 are fixed to a conveyor chain 20 which moves in direction of the shown arrow. The objects 18 as well as the holding means 19 and the conveyor chain 20 are of electrically conductive material, especially of metal. As can be seen from the drawing, the conveyor chain 20 is connected to the ground 22 via a sliding contact 21.

A further sliding contact 23 is provided for applying a negative test high voltage to the objects 18 prior to the entrance into the coating chamber 10. The test high voltage has a magnitude to 20 kV, preferably is chosen to be under 5 kV and is applied between the sliding contact 23 and a further earth connection 25 so that a closed circuit is provided when one object 18 is in contact with the sliding contact 23.

The test high voltage 24 is provided by a test device 26 which includes a predetermined internal resistance 27 for limiting the current, a current measuring instrument 28 and a DC source 29. The outlet of the test device 26 is connected to a switch device 32 via connecting lines 30 and 31. The switch device 32 is provided to stop the coating plant in case an insulation is obtained between the object 18 in contact with the sliding contact 23 and the holding means 19 which insulation has a contact resistance above the maximum value.

The described arrangement operates as follows:

The objects are continuously fed to the coating chamber 10 by the holding means 19 and the conveyor chain 20. Before the objects 18 enter the coating chamber 10, a negative test high voltage of for example 1.5 kV is applied via the sliding contact 23. For safety reasons, a maximum admissible flow of current of 10 mA is based upon so that a contact resistance of 150 Kohm results therefrom which magnitude is far the maximum permissible contact resistance of 1 Mohm. The base critical value for the test current to be measurable by the current measuring instrument 28 is defined in the present embodiment as 5 mA, which corresponds to a total resistance of 300 kOhm.

As already mentioned, when the measured actual current is below the critical value of 5 mA, then an inadmissible insulation is obtained between the object 18 to be coated and the holding means 19 or the conveyor chain 20, so that the switch device 32 stops the coating plant. In case of a too low test current and thus a too high contact resistance between the object 18 and its metallic holding part, a too high energy is stored at the subsequent application of the coating direct voltage of for example 100 kV because of the capacitance of the object to be coated prior to the igniting of the electric arc which energy is above the igniting energy of the sprayed coating powders or particles. The capacitances between the objects 18 and the holding means 19 as measured upon occurrence of an insulation is within the range of approximately 20 to 80 pF. Based upon this capacitance and the applied voltage, an energy of 0.5 $CU^2$ is calculated which energy is released in the arc. The mentioned capacitance is true for different parts which are conventionally coated by powder coating method using high voltages. This method operates in such a known manner that the charged powder particles adhere to the metallic object 18 and in the following process, these powder particles are melted and cured to the coating at temperatures of 120° C. to 180° C.

Upon basing of a maximum admissible arc energy of 5 mWs, a maximum admissible test high voltage 24 of 10–20 kV is calculated when providing a capacitance of the objects of 20–80 pF depending on the size of the objects. It is, however, advantageous in view of additional security to limiting the test voltage to a value of 1–5 kV, preferably to a value of 1.5 kV to 3 kV. The dimension of such a test voltage, occurring thin insulations between the objects 18 and the holding means 19 and possibly between the holding means 19 and the conveyor chain 20 are burned away or broken through, so that the plant does not have to be stopped despite the originally occurring insulation.

In the actual coating chamber 10, no higher arc energies can occur when applying a negative high voltage so that the ignition of the powder air mixture and thus the danger of explosion is excluded.

Any occurring contaminations do also not impair the method according to the invention which guarantees that the charging of the objects 18 to be coated in the coating chamber 10 remains under a predetermined value although when using a pure direct voltage-resistance measurement an inadmissibly high insulation would be indicated which would lead in the known test methods to the stopping of the plant.

As described, a negative direct voltage is used for the coating process as well as for the test stage. The use of corresponding direct voltages guarantees that upon following application of a direct voltage at equal magnitude the contact to earth connection 22 is assured so that no arc having a higher energy than the predetermined energy can be developed. It is, however, also possible taking into account the different insulation conditions to use a positive test voltage instead of the used negative test voltage 24. Furthermore, it is also possible to use an alternating voltage as test voltage 24 wherein, however, it is necessary because of safety reasons to limit the flowing current through the internal resistance 27 to a value under 4 mA. When using a test voltage of again 1.5 kV, this would result in an internal resistance of 375 Kohm and an internal resistance of maximum 375 kOhm when the plant is stopped at currents equal or below 2 mA.

It will be understood that each of the elements described above, or two or more together, may also find a useful application in other types of coating plants differing from the types described above.

While the invention has been illustrated and described as embodied in a method for protecting a coating plant, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of protecting a plant for coating objects with particles against explosion by sparkovers obtained through electric charging of the objects, wherein the objects are connected to a first earth connection via holding means, the method comprising the steps of:

applying sucessively a test high voltage between one of the objects and a second earth connection when the respective object closes the circuit for preventing between the object and/or the holding means and the first earth connection the generation of an electric arc of an energy higher than a permitted maximum energy, wherein an insulation occurring between the object and/or the holding means and the first earth connection and having a contact resistance smaller than a permitted maximum value is overcome by an arcthrough of low energy; and measuring the current flowing in the closed circuit for determining the contact resistance of the insulation wherein the plant is stopped only when the actual value of the current is below a minimum value because the contact resistance is above the permitted maximum value.

2. A method as defined in claim 1, wherein the permitted maximum energy of the electric arc is below 5 mWs.

3. A method as defined in claim 1, wherein the minimum value of the current is 5 mA.

4. A method as defined in claim 2, wherein the test high voltage is a direct voltage.

5. A method as defined in claim 4, wherein the direct voltage is below 20 kV.

6. A method as defined in claim 5, wherein the direct voltage is within the range of 1–5 kV.

7. A method as defined in claim 6, wherein the direct voltage is within the range of 1.5–3 kV.

8. A method as defined in claim 1, wherein the applying step of the test high voltage to the object to be coated occurs only momentarily.

9. A method as defined in claim 1, wherein the applying step of the test high voltage to the object to be coated is obtained by an elastic sliding contact.

10. A method as defined in claim 4, wherein the test high voltage has the same polarity as the charge applied to the particles.

11. A method as defined in claim 10, wherein the direct voltages for testing and coating are negative.

12. A method as defined in claim 1, wherein the test high voltage is an alternating voltage.

13. A method as defined in claim 12, wherein the minimum value of the current is 4 mA.

14. A method for coating objects in a coating plant, comprising the steps of:

connecting the object to a first earth connection via holding means;

guiding the object along a predetermined path;

applying successively a test high voltage between one of the objects and a second earth connection when the object closes the circuit for preventing between the object and/or the holding means and the first earth connection the generation of an electric arc of an energy higher than a permitted maximum energy, wherein an insulation occurring between the object and/or the holding means and the first earth connection and having a contact resistance smaller than a permitted maximum value is overcome by an arc through having an energy smaller than the permitted maximum value;

measuring the current flowing in the closed circuit for determining the contact resistance of the insulation wherein the plant is stopped when the actual value of the current is below a minimum value as the contact resistance is higher than the permitted maximum value;

spraying charged particles onto the object in a coating chamber; and melting and curing the particles adhered to the object for providing a coating thereon.

15. A method as defined in claim 14, wherein the applying step is prior to the spraying step of the charged particles onto the object in the coating chamber.

16. Apparatus for coating objects in a coating plant, comprising a coating chamber provided with means for spraying charged particles onto the object; means for holding and continuously feeding the object to the coating chamber, the holding means being connected to a first earth connection; means for applying successively a high voltage between one of the objects and a second earth connection when the object closes the circuit for preventing between the object and/or the holding means and the first earth connection the generation of an electric arc of an energy higher than a permitted maximum energy, wherein an insulation occurring between the object and/or the holding means and the first earth connection and having a contact resistance smaller than a predetermined maximum value is overcome by an arcthrough having an energy smaller than the permitted value; means for measuring the current flowing in the closed circuit for determining the contact resistance of the insulation; and means for stopping the plant only when the actual value of the current is below a minimum value because the contact resistance is higher than the permitted maximum value.

* * * * *